US006269237B1

(12) United States Patent
Olbrich et al.

(10) Patent No.: US 6,269,237 B1
(45) Date of Patent: Jul. 31, 2001

(54) PRINTER WITH TWO PRINTING UNITS AND PAIRS OF TRANSPORT ROLLERS DRIVEN BY STEP MOTORS

(75) Inventors: Otto Olbrich, Taufkirchen; Peter Thiemann, Munich, both of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/284,825

(22) PCT Filed: Oct. 21, 1997

(86) PCT No.: PCT/DE97/02450

§ 371 Date: Apr. 21, 1999

§ 102(e) Date: Apr. 21, 1999

(87) PCT Pub. No.: WO98/18060

PCT Pub. Date: Apr. 30, 1998

(30) Foreign Application Priority Data

Oct. 22, 1996 (DE) ..... 196 43 665

(51) Int. Cl.[7] ..... G03G 15/00
(52) U.S. Cl. ..... 399/401; 399/6
(58) Field of Search ..... 399/401, 364, 399/388, 397, 400, 402, 403, 6, 16

(56) References Cited

U.S. PATENT DOCUMENTS

| | | | | |
|---|---|---|---|---|
| 4,438,917 | | 3/1984 | Janssen et al. . | |
| 4,497,569 | | 2/1985 | Booth, Sr. . | |
| 4,635,920 | | 1/1987 | Kodama . | |
| 4,681,313 | | 7/1987 | Yokovama et al. . | |
| 4,745,490 | * | 5/1988 | Shimizu et al. | 358/300 |
| 4,974,828 | | 12/1990 | Matsuo et al. . | |
| 5,030,991 | | 7/1991 | Zaitsu et al. . | |
| 5,208,640 | * | 5/1993 | Horie et al. | 399/298 X |

FOREIGN PATENT DOCUMENTS

| | | |
|---|---|---|
| 34 07 847 | 9/1984 | (DE) . |
| 38 18 982 | 12/1988 | (DE) . |
| 40 06 586 | 9/1990 | (DE) . |
| WO 89/08282 | 9/1989 | (WO) . |

* cited by examiner

*Primary Examiner*—Quana Grainger
(74) *Attorney, Agent, or Firm*—Hill & Simpson

(57) ABSTRACT

A printer is provided with two similar printing units fed with sheet-like material via a common input section. Printed material is output via a common output section. Groups of transport rollers and individual transport rollers are driven by step motors.

29 Claims, 12 Drawing Sheets

PRINTER WITH TWO PRINTING UNITS AND PAIRS OF TRANSPORT ROLLERS DRIVEN BY STEP MOTORS

BACKGROUND OF THE INVENTION

The invention is directed to an apparatus, particularly a printer or copier, having a first electrographic printing unit that prints an image pattern onto a sheet-shaped material, having an input section via which the sheet-shaped material can be individually supplied in succession, and having an output section via which the printed, sheet-shaped material is individually successively output.

In a known high-performance printer having only a single printing unit, the individual printer components are exactly matched to one another, so that an extremely dependable operating condition with high printing performance is achieved. In order to increase the printing performance even farther, design changes must be undertaken at these components, this leading to a high development expense and increasing the probability of failure due to the redesign of the individual components.

U.S. Pat. No. 5,208,640 discloses a printer that comprises two identical printing units to which sheets to be printed can be supplied individually in succession via a common input section.

Given a printer disclosed by DE 38 18 982 C2, pairs of transport rollers are arranged in the transport path of the paper. Various pairs of transport rollers are thereby driven in common via synchronous belts by a single drive or a few central drives.

When the transport of the sheet-shaped material makes it necessary that pairs of transport rollers have different speeds or must change their rotational sense, then the rollers of the pairs of transport rollers in the previous solutions have been driven via switchable couplings. Further, gearings were arranged preceeding the transport rollers in order to set the speed and the rotational sense according to the required operating mode. Switchable couplings must also be arranged preceding these gearings. It has now been shown that such switchable couplings have great tolerances in the switching times and that high accelerations result when these couplings are switched. A further disadvantage is that the drive belts for the synchronous drive of the transport rollers are extremely long in part. The known solution is therefore very involved and has low operating dependability.

SUMMARY OF THE INVENTION

An object of the invention is to specify an apparatus of the type initially cited whose transport system for sheet-shaped material enables a plurality of operating modes of the apparatus and that can be realized with little expense.

In the method and apparatus of the present invention, a first electrographic printing unit is provided that prints an image pattern on a sheet-shaped material. An input section via which the sheet-shaped material is supplied individually in succession is provided. An output section is provided over which the printed sheet-shaped material is output individually in succession. A turning device is provided for the sheet-shaped material. A substantially identical second printing unit is provided with sheet-shaped material being supplied thereto via the input section. The sheet-shaped material printed by the second printing unit is output via the output section. Transport roller pairs driven by drives are arranged in transport paths for the sheet-shaped material from the input section to the output section, the transport roller pairs having a spacing from one another slightly smaller than a dimension of the material in a conveying direction of the material. The transport roller pairs have different rotational speeds and conveying directions dependent on an operating mode of the apparatus. Stepping motors with reversible rotational sense or clock-controlled motors are provided as the drives. Predetermined, driven transport roller pairs are combined to form groups directly coupled to one another and respectively driven by a single drive. A first transfer printing transport path along the first printing unit, and a separate, second transfer printing transport path along the second printing unit, are provided. The input section contains a shunt that supplies the sheet-shaped material either to the first transfer printing transport path or to the second transfer printing transport path. The first transfer printing transport path and the second transfer printing transport path are connected by a connecting channel through which sheet-shaped material is conveyed in one or in both conveying directions. The sensor is arranged at a plurality of the transport roller pairs, the sensor signaling passage of an edge of the sheet-shaped material. A predetermined transport roller pair is accelerated or retarded dependent on signals of the sensor.

Two substantially identically constructed printing units are utilized in the apparatus of the invention. The components for these printing units, for example the electronic control, the developer units, the toner delivery and discharge devices, etc. can be retained nearly unmodified. In and of itself, thus, each printing unit has very high operating dependability. Both printing units use a common input section via which the sheet-shaped material is supplied. Both printing units likewise use an output section in common for delivering the printed, sheet-shaped material. As a result thereof, the new apparatus is very compactly constructed and can be manufactured with little expense. The printing performance is clearly enhanced due to the two printing units.

Stepping motors reversible in rotational sense are provided as drives in the invention. These stepping motors can be set to the desired speed on the basis of a predetermined clock frequency, whereby high synchronism with other, identical drives is assured during acceleration and when decelerating the drive. Various driven transport rollers are combined to form groups that are driven by a single stepping motor. The group formation leads to the fact that the structural expense is reduced, whereby the flexibility for setting specific speed profiles continues to be established. As a result of the employment and arrangement of these drives, switching couplings and gearings are not required, as a result whereof the operating dependability is enhanced and the hardware outlay remains small. The division into groups, on the one hand, and into individual drives within the apparatus, on the other hand, leads to the fact that a plurality of paper paths can be realized in order to still be able to implement printing jobs with the remaining, other printing units given potential outage of one printing unit.

In the invention, single sheets on different transport sections in the printer can have different speeds, which partially amount to a multiple of the transfer printing speed. As a result thereof, it is possible to convey the respective single sheet following and preceding the transfer printing with a higher speed then the transfer printing speed. In this way, the overall throughput in the printer can be enhanced and longer dwell times on a path section due, for example, to passage through a shunt or a turn-over unit, can be in turn compensated by high conveying speeds. Due to the high speed outside the printing units, it can also be assured that the prescribed spacings between single sheets that are output are adhered to and the proper output sequence is observed despite potentially different paths of the individual sheets in the printer.

It is provided according to one exemplary embodiment that a sensor unit is arranged at a plurality of transport roller pairs, preferably at each transport roller pair, said sensor unit signaling the passage of a leading edge or of a trailing edge of the sheet-shaped material. This sensor unit preferably contains two light barriers, the one being arranged preceeding the transport roller pair and the other being arranged following the transport roller pair. Due to the signals of the sensor unit, where a single sheet is located can be determined at any time. Further, jam situations in the apparatus can be recognized. Dependent on the recognition of a leading edge or of a trailing edge of the single sheet, the respective transport roller pair is accelerated or retarded. In this way, the passage of the single sheet can be optimized by the control, and the printer can work with the highest possible printing speed without causing a paper jam in the printer.

According to a development of the invention, a first transfer printing transport path is provided for the first printing unit and a separate, second transfer printing transport path is provided for the second printing unit. The transfer printing for both printing units occurs with the same speed. Since each printing unit has its own transfer printing transport, sheet-shaped material can continue to be printed with the other printing unit given outage of one printing unit.

Another exemplary embodiment provides that the first transfer printing transport path and the second transfer printing transport path are connected by a connecting channel through which sheet-shaped material can be conveyed in one or in both transport directions. As a result of these techniques, material can be supplied from the first printing unit to the second printing unit as well as from the second printing unit to the first printing unit in order to print it. The connecting channel has thus created a return that connects the two printing units to one another, versatile printing processes being enabled as a result thereof.

A further embodiment provides that the sheet-shaped material is turned over when being transported from the first transfer printing transfer path to the second transfer printing transport path. In this way, each printing unit can print the front side and can also print the back side of a single sheet. When developer stations having different colors are employed for the two printing units, then two image patterns with two different colors can be printed on each side of the single sheet, i.e. what is referred to as a two-colored duplex mode, also called duplex color spot mode, can be realized.

Exemplary embodiments of the invention are explained below with reference to the drawing.

DESCRIPTION OF THE PREFERRED EMBODIMENTS

Figure 1:
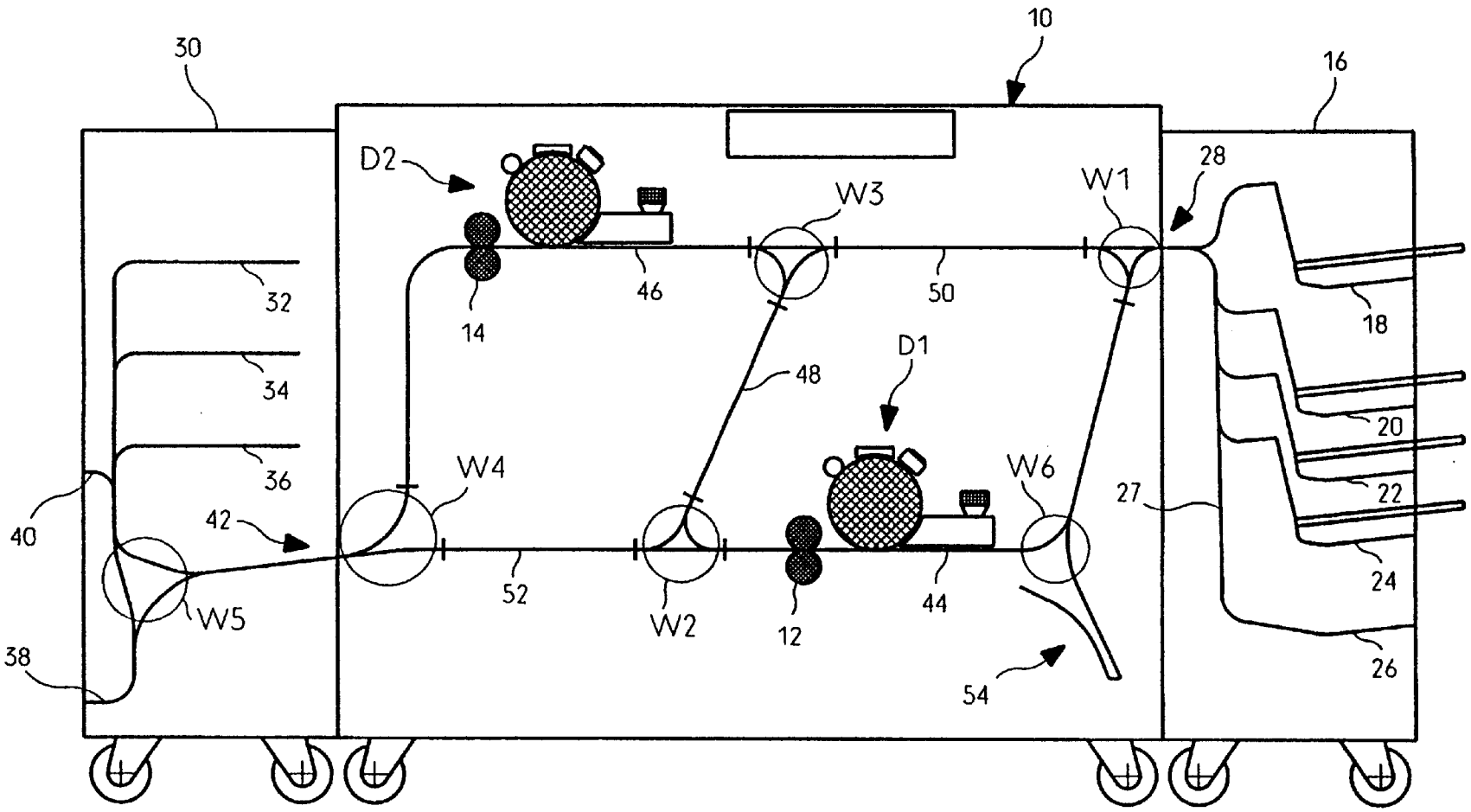
FIG. 1 is a schematic structure of a high-performance printer wherein the invention is realized.

FIG. 1 shows a high-performance printer 10 that serves for fast printing of single sheets of paper. The high-performance printer 10 contains a first, lower printing unit D1 as well as a second, upper printing unit D2. The two printing units D1, D2 work according to the known electrographic method with identical transfer printing speed. The printing units D1, D2 are followed by fixing devices that are schematically indicated in FIG. 1 by two roller pairs 12, 14. A paper input 16 that contains a plurality of supply reservoirs 18 through 24 with single sheets as well as an external paper input channel 26 via which single sheets can be supplied from the outside is connected to the high-performance printer 10. Single sheets are supplied to an input section 28 via a transport channel. At the output side, a paper output 30 that contains a plurality of output containers 32 through 36 is connected to the high-performance printer 10. Further, two output channels 38, 40 are provided via which the individual sheets can be output to further-processing stations. The high-performance printer 10 outputs the printed single sheets via the output section 42.

Transport paths for the transport of the individual sheets with which various operating modes of the high-performance printer are realized are arranged in the inside of the high-performance printer 10. Respective transfer printing transport paths 44, 46 are allocated to the printing units D1, D2, these transport paths 44, 46 being respectively set by drives such that the supply single sheets have their transfer printing speed at the printing units D1, D2. The two transfer printing transport paths 44, 46 are connected to one another via a connecting channel. The transport path around the first printing unit D1 is supplemented by a delivery channel 50 to form a ring, single sheets also capable of being supplied to the second transfer printing transport path 46 from the input section 28. The transport path for the second printing unit D2 is supplemented by a discharge channel 52 to form a ring in a similar way, single sheets printed by the printing unit D1 being capable of being supplied to the output section 42 thereover.

A first shunt W1 is arranged between the input section 28, the first transfer printing transport path 44 and the delivery channel 50, this making it possible that single sheets are optionally supplied from the input section 28 to the first transfer printing transport path 44 or to the delivery channel 50. A further version is comprised therein that single sheets transported onto the delivery channel 50 in the direction of the shunt W1 can be supplied to the first transfer printing transport path 44.

A second shunt W2 and a third shunt W3 are also arranged at the ends of the connecting channel 48 and respectively connect the adjacent transport paths 44, 48, 52 or, respectively, 46, 48, 50. A fourth shunt W4 is located in the proximity of the output section 42 and connects the adjacent transport paths. The paper output 30 contains a fifth shunt W5 that works as a turn-over. Further, an ejection unit 54 should also be pointed out, reject sheets being supplied thereto via a shunt W6.

Various operating modes of the high-performance printer 10 can be realized by the arrangement described in FIG. 1. The various operating modes are schematically shown in the following FIGS. 2 through 7. The respective conveying of the single sheets is illustrated on the basis of arrows.

Figure 2:
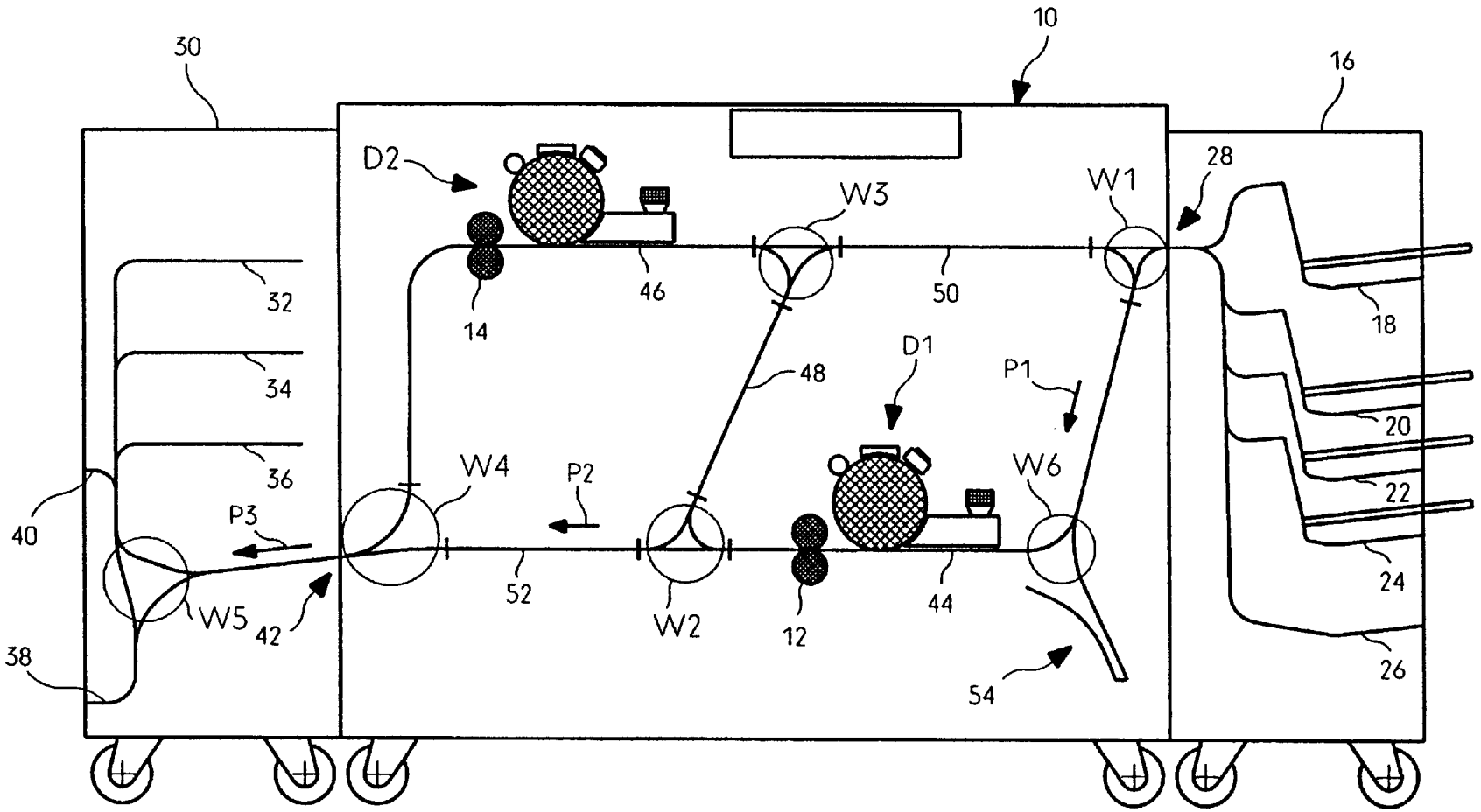
FIG. 2 shows the operating mode of simplex printing with the lower printing unit, shown schematically.

FIG. 2 schematically shows simplex printing with only one printing unit. In this simplex printing, only one side of a single sheet is printed. The single sheet proceeds via the input section 28 and the correspondingly switched shunt W1 along the arrow P1 to the first transfer printing transport path 44 and is printed at the printing unit D1. Subsequently, the single sheet is output into the paper output 30 (arrow P3) along the discharge channel 52 (arrow P2) via the output section 42.

Figure 3:
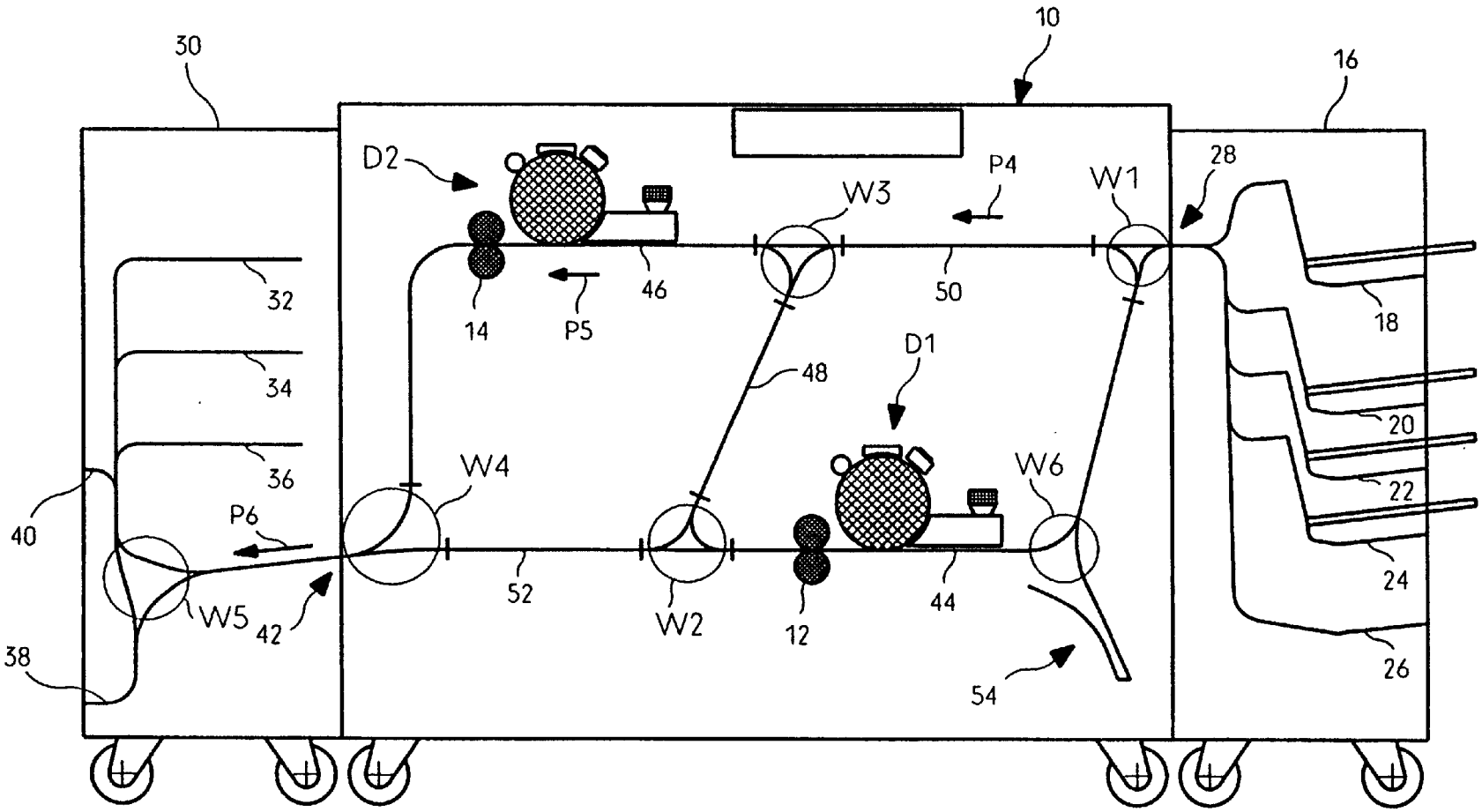
FIG. 3 shows the operating mode of simplex printing with the upper printing unit, shown schematically.

FIG. 3 shows the simplex printing with the upper, second printing unit D2. The transport of the single sheet ensues via the delivery channel 50 (arrow P4) and the second transfer printing transport path (arrow P5) to the paper output 30 (arrow P6).

Figure 4:
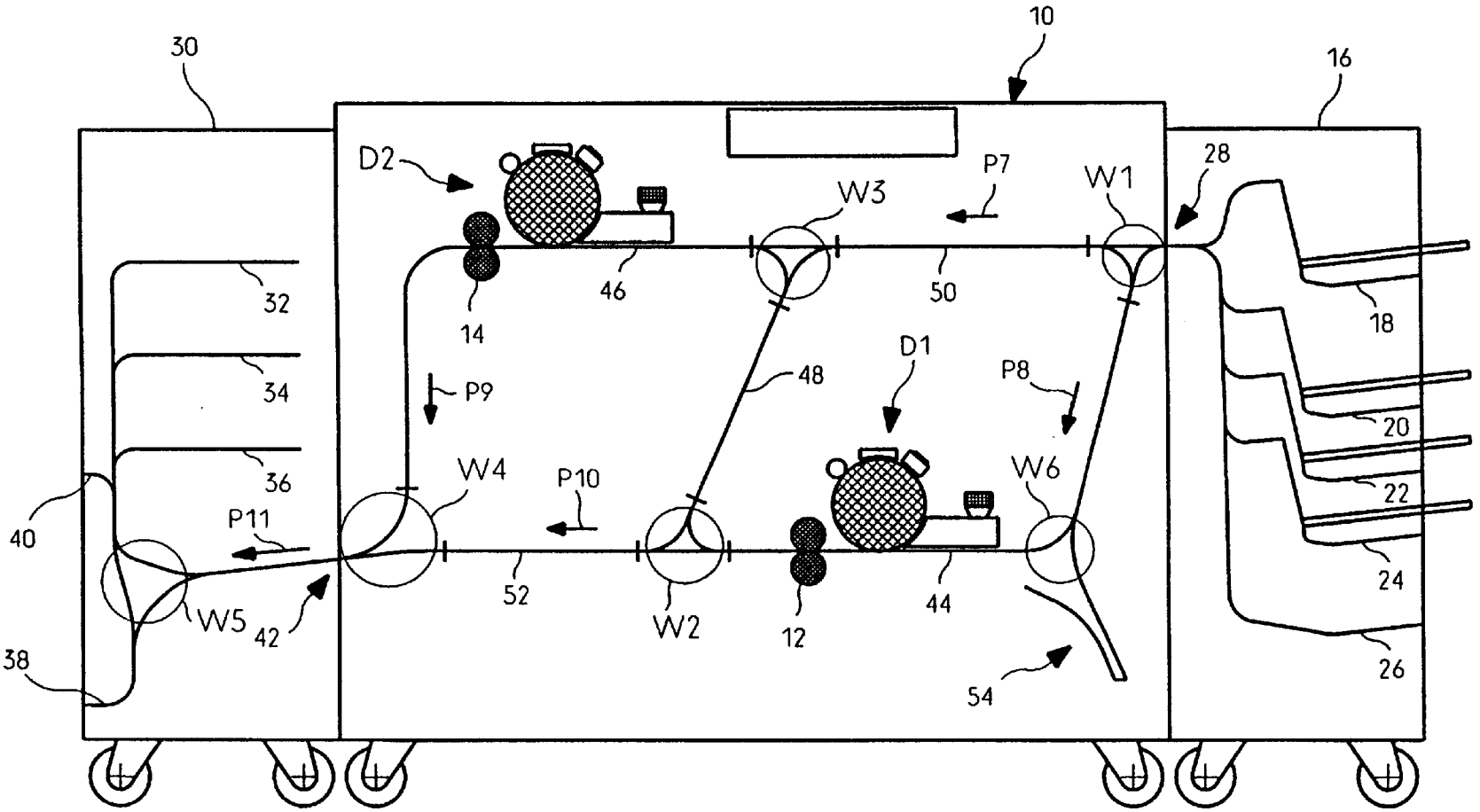
FIG. 4 illustrates the operating mode of alternating simplex printing.

Given alternating simplex printing with enhanced printing performance, single sheets having at least twice the transfer printing speed are supplied via the input section 28 to the printing units D1, D2. FIG. 4 schematically shows the transport of the single sheets. The shunt W1 supplies single sheets (arrows P7, P8) to the delivery channel 50 or, respectively, the first transfer printing transport path 44 in alternating fashion. While being transported to the printing units D1, D2, the single sheets are decelerated to transfer printing speed, are respectively printed thereat on their front side and are subsequently further-conveyed to the shunt W4. In this further-conveying according to arrows P9, P10, the single sheets are accelerated to at least twice the transfer printing speed, so that they can be output spaced from one another at the common output section via the shunt W4 and can be further-transported according to the arrow P11 in the paper output 30, being further-transported successively with at least twice the transfer printing speed.

In what is referred to as the operating mode of "alternating simplex printing", it is thus inventively provided that the single sheets for the input section 28 in the paper input 16 are supplied to the printing units D1, D2 with at least twice the transfer printing speed. In the paper output 30, too, the single sheets are likewise further-conveyed and deposited with at least twice the speed. As a result of this technique, the single sheets arrive at the common input section 28 and at the common output section 42 without the possibility of a collision of single sheets and, consequently, of a paper jam occurring. The transport paths for the single sheets supplied to the first printing unit D1 and the single sheets supplied to the second printing unit D2 are preferably symmetrically designed and are at least of equal length, so that the single sheets on both transport paths can be decelerated and accelerated with the same speed profile. As a result thereof, it is possible to identically construct the drives and devices required for the transport. Further, it is possible to employ identical controls.

Figure 5:
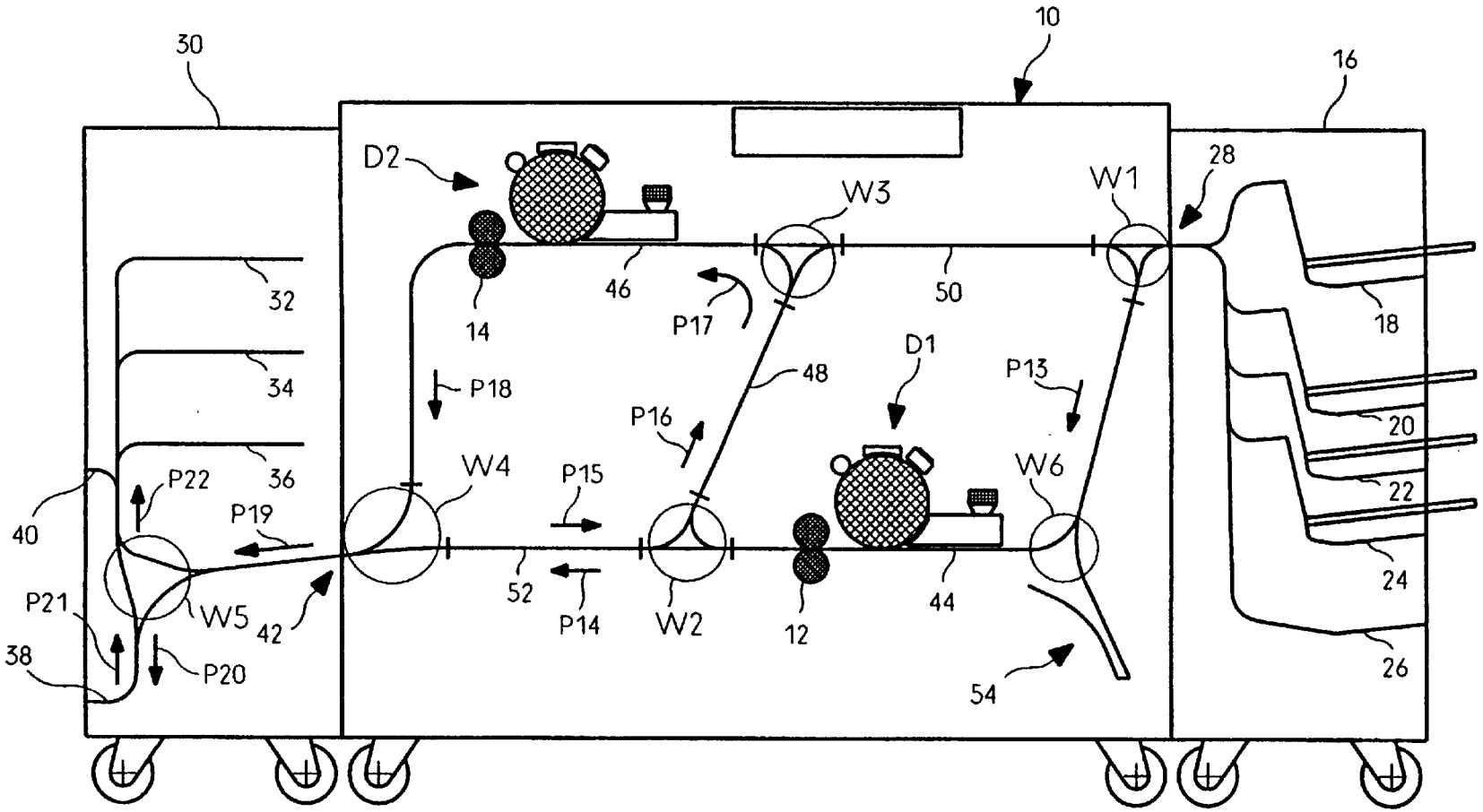
FIG. 5 illustrates the operating mode of duplex printing.

FIG. 5 schematically shows the duplex printing mode wherein the single sheets are printed on both sides. The single sheets supplied to the input section 28 are supplied through the first shunt W1 to the first transfer printing transport path 44 (arrow P13). After being printed by the printing unit D1, the respective single sheet passes through the turn-over path WZ according to the arrow P14 and is conveyed out via the shunt W2. This turn-over or shunt path WZ is a part of the discharge channel 52. Subsequently, the conveying direction is reversed according to arrow P15, and the shunt W2 then conducts the single sheet into the connecting channel 48 according to the arrow P16. The single sheet is then redirected by the shunt W3 in the direction of the arrow P17 to the second transfer printing transport path 46. The back side of the single sheet which has not yet been printed is thus supplied to the printing unit D2 for printing. Subsequently, the single sheets are supplied to the shunt W4 according to the arrow P18 and are transported into the paper output 30 along the arrow P19. Since the single sheet is transported with its back side pointing up in this condition, it must be turned over again before being deposited into the compartments 32 through 36. The shunt W5 serves this purpose. The single sheet is first guided through the shunt W5 in the direction of the arrow P20 for a predetermined turn-over path. The transport direction is then reversed according to the arrow P21, and the shunt W5 conveys the single sheet in the direction of the arrow P22, whereupon it is positive in the deposit compartments 32 through 36 with its proper side up.

As can be seen, the shunt W2 works as a turn-over device in order to supply the back side of the single sheet to the printing unit D2. Alternatively, the shunt W3 can also be utilized for the turn-over. The single sheet leaving the printing unit D1 is then supplied by the shunt W2, the connecting channel 48, the shunt W3 and then a short turn-over distance along the delivery channel 50 in the direction of the shunt W1. Subsequently, the conveying direction is reversed, and the shunt W3 conducts the single sheet in the direction of the printing unit W2 with its back side facing up.

Figure 6:
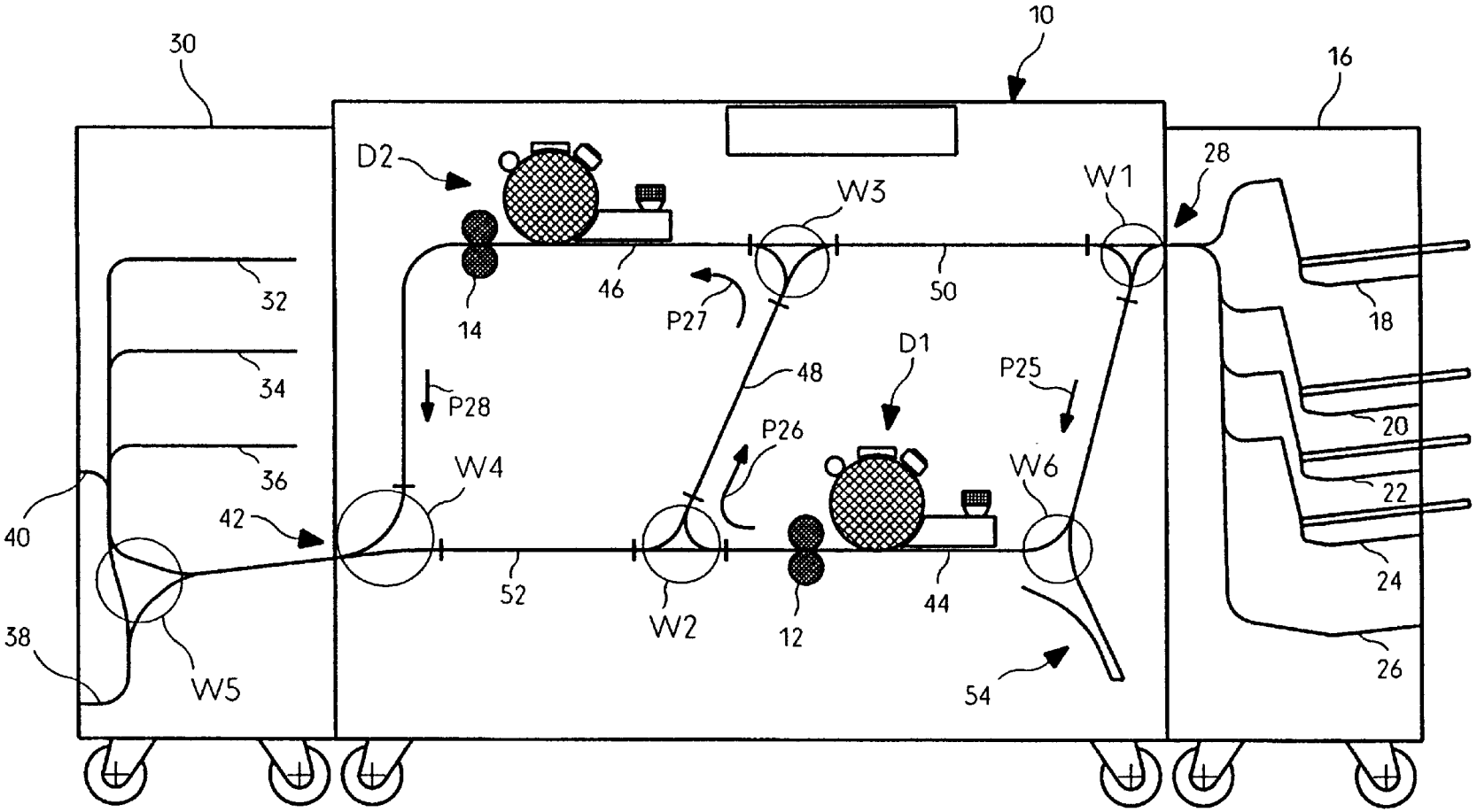
FIG. 6 shows the operating mode of two-color simplex printing.

FIG. 6 schematically shows another operating mode, two-color simplex printing, wherein the front side of a single sheet is printed with two image patterns of different color. The two printing units D1, D2 print image patterns with a different color. In the operating mode of two-color simplex printing, the individual sheet is supplied to the printing unit D1 via the shunt W1 (arrow P25). Subsequently, the single sheet is supplied to the connecting channel 48 via the shunt W2 without being turned over and is then supplied to the printing unit D2 via the shunt W3 (arrows P26, P27). The printing unit D2 prints the front side with a color that is different from the color of the printing unit D1. Subsequently, the single sheet is output to the paper output 30 via the shunt W4 (arrow P28).

Figure 7:
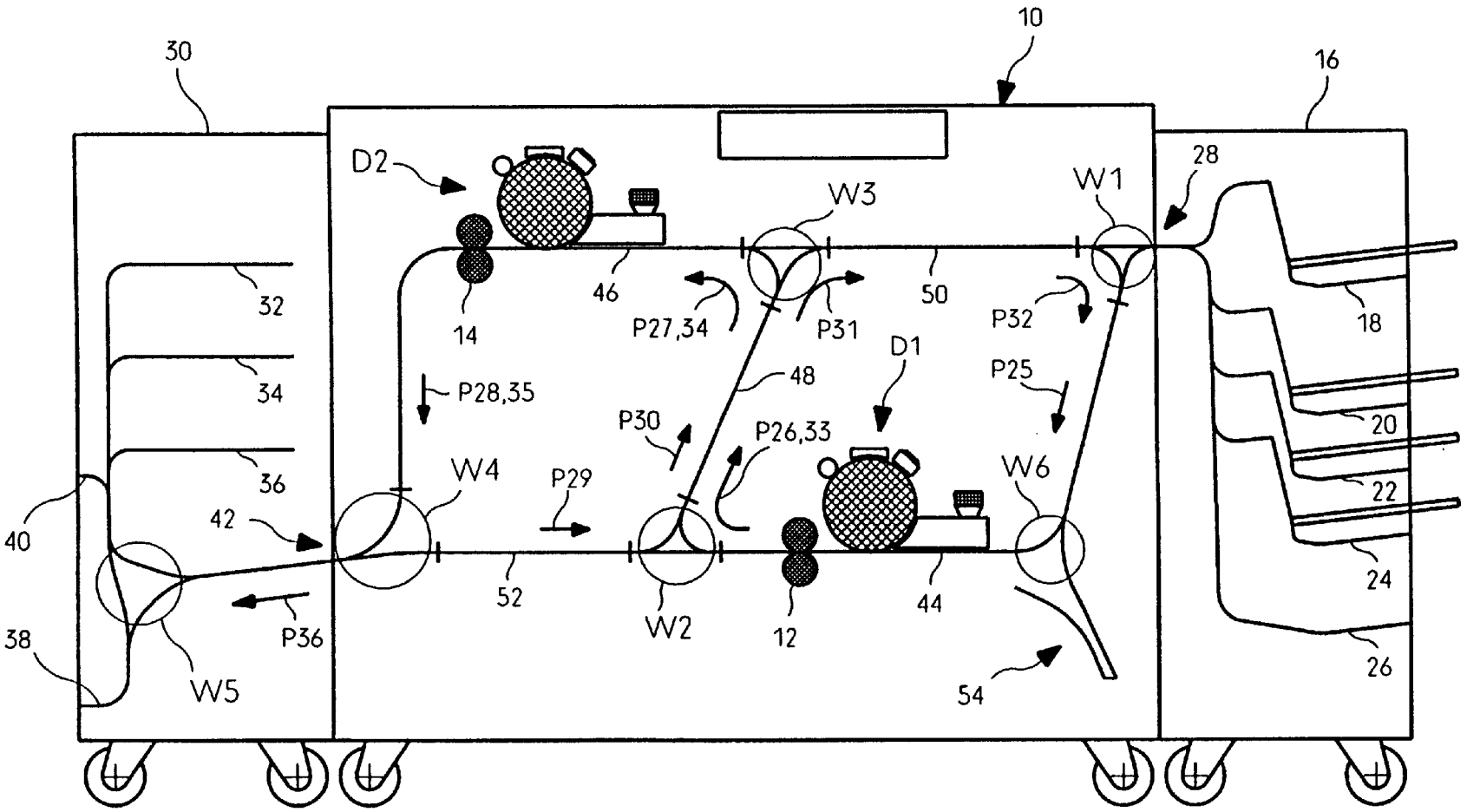
FIG. 7 shows the operating mode of two-color duplex printing, schematically.

FIG. 7 schematically shows the transport path of a single sheet in the operating mode of two-color duplex printing, whereby the front side and the back side of a single sheet are printed with image patterns of different color. A prerequisite therefor is that the printing units D1 and D2 print differently colored print images. For two-color printing of the front side, one proceeds as in the operating mode of two-color simplex printing according to FIG. 6. The arrows P25, P26, P27, P28 illustrate the transport path. Subsequently, the single sheet is resupplied to the printing unit D1. The arrows P21 through P36 illustrate the transport path of the single sheet for printing the back side. For this back side to be supplied to the printing unit D1, the single sheet must be turned over on the transport path between the printing unit D2 and the printing unit D1. This turning can occur, for example at the shunt W4, at the shunt W2 or at the shunt W3. In a preferred exemplary embodiment of the invention, the turn-over occurs with the assistance of the shunt W4, i.e. the single sheet is initially transported in the direction of the shunt W5 for a short turning distance, the conveying direction is then reversed, and the single sheet is further-conveyed in the direction of the shunt W2. After the transport into the paper output 30 according to the arrow P36, a further turning-over by the shunt W5 occurs and, subsequently, the deposit of the single sheet printed double-sided with respect to the two color images occurs with the proper side up.

An alternative transport of the single sheet through the high-performance printer 10 for realizing the operating mode of two-colored duplex printing can ensue in the following way. First, the single sheet is supplied for the input section 28 via the shunt W1 to the printing unit D1, its front side is printed, and it is subsequently conducted via the shunts W2 and W3 for turn-over briefly in the direction of the shunt W1. After passing the shunt W3, the conveying direction is changed in the direction of the printing unit D2, and the single sheet is conveyed on the transfer printing transport path 46. The shunt W3 thus serves as a turn-over station. The back side of the single sheet is accordingly printed at the printing unit D2. Subsequently, the single sheet is resupplied to the first printing unit D1 via the shunts W4, W2, W3, and W1 in order to now print the back side. The single sheet must be turned over for this purpose. This occurs at the shunt W4, whereby it is briefly conveyed in the direction of the shunt W5, the conveying direction is reversed and it is transported in the turn-over condition in the direction of the shunt W2. After printing the back side of the single sheet to the printing unit D1, the single sheet is supplied to the printing unit D2 via the shunts W2 and W3, whereby it is turned over. The front side is now printed by the printing unit D2. Subsequently, the single sheet is conducted via the shunt W4 to the unit compartments 32 through 36. Since it now arrives in the deposit 30 in proper attitude, i.e. with the top side up, it need not be turned over again by the shunt W5.

Figure 8:
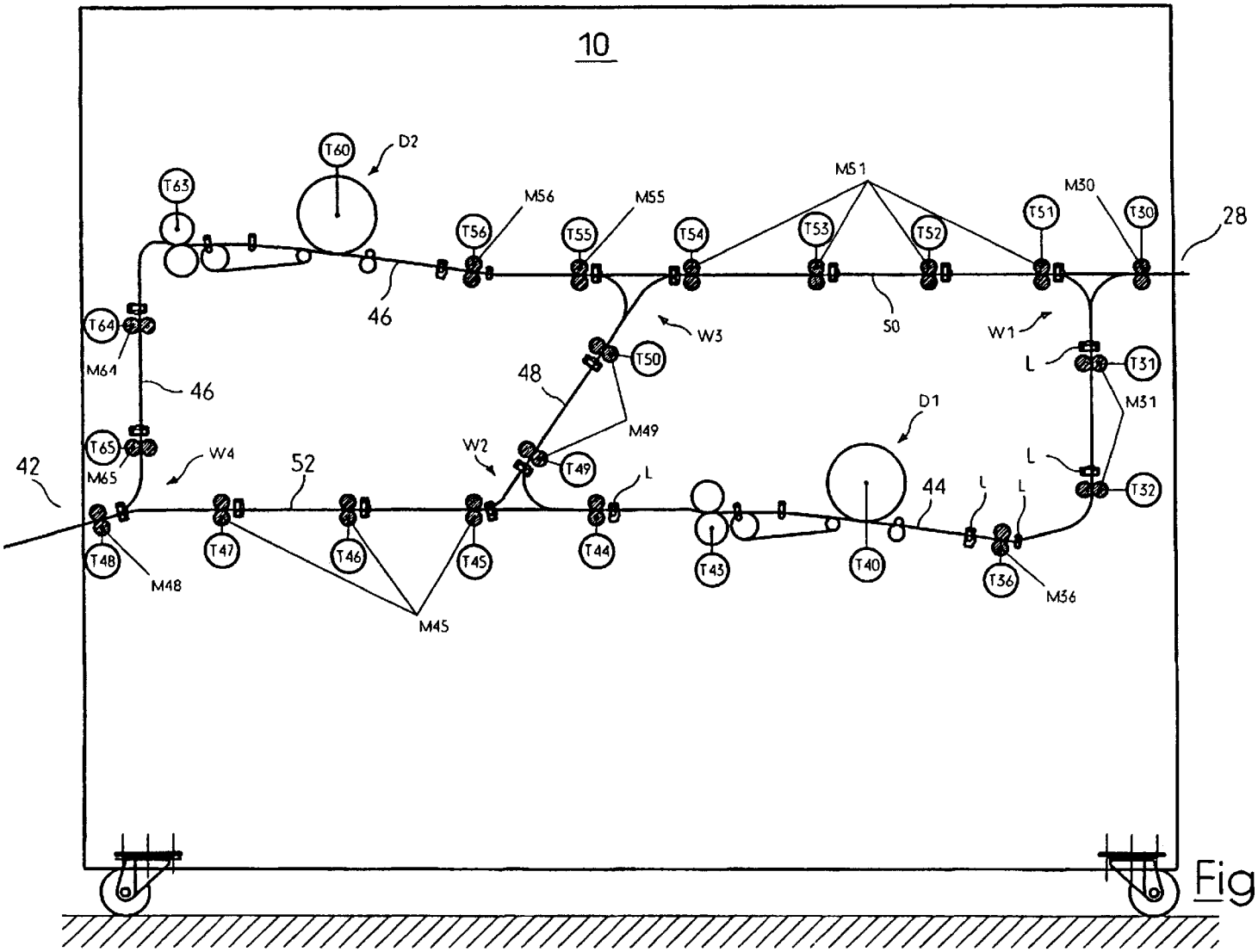
FIG. 8 illustrates the distribution of the transport roller pairs in the printer along the transport path of the individual sheets.

FIG. 8 schematically shows the possible transport paths of a single sheet in the high-performance printer 10. The various transport sections 44, 46, 48, 50, 52 contain transport roller pairs T31 through T65 according to the shown illustration. The elements T40 and T60 that relate to the printing units D1 and D2 form an exception, as do the elements T43, and T63 that relate to fixing roller pairs of the fixing stations respectively following the printing units D1, D2. The transport roller pairs T30 and T48 with allocated stepping motors M30 and M48 must be additionally mentioned, these belonging to the shunts W1 or, respectively, W4. At least one light barrier L is allocated to each transport roller pair T31 through T65. The reference character L for each light barrier is merely entered for the transport roller pairs T31 through T44 of the first transfer printing transport path 44 in FIG. 8 and the following Figures for reasons of clarity. The light barriers L serve the purpose of detecting the passage of the leading edge or, respectively, of the trailing edge of the single sheet, so that the control knows the location of the single sheet on the various transport paths at all times and accelerates or decelerates the respective transport roller pair T30 through T65 according to the operating mode that has been set. The various transport roller pairs T30 through T65 have a spacing from one another that is slightly smaller than the dimension of the individual sheet in the conveying direction. In the case of a DIN A4 single sheet having a dimension of 210 mm in the conveying direction, an expedient spacing of the transport roller pairs T31 through T65 of approximately 200 mm should be adhered to.

Stepping motors M30 through M65 with a reversible rotational sense are provided as drives for the driven roller of the transport roller pairs T30 through T65, the allocation thereof to the various transport roller pairs being shown in FIG. 8. Specific transport roller pairs are combined to form groups and are respectively driven by a single stepping motor. In the delivery channel 50, thus, the transport roller pairs T51, T52, T53, T54 are combined to form a group that are driven by a single stepping M51. The respective, driven rollers of the transport roller pairs T51 through T54 are coupled to one another by toothed belts, a faultless synchronous running being assured as a result thereof.

In the first transfer printing transport path 44, the transport roller pairs T31 and T32 are combined as a group and are driven by the stepping motor M31. In the connecting channel 48, the transport roller pairs T49 and T50 are combined as a group that are driven by the single stepping motor M49. In the second transfer printing transport path 46, each transport roller pair T55, T56, T64, T65 is driven by a separate stepping motor M55, M56, M64, M65. The discharge channel 52 contains the transport roller pairs T45, T46 and T47 that are combined to form a group and are driven in common by the single stepping motor M45.

It can thus be seen that various transport roller pairs are combined into groups that are respectively driven by a single stepping motor on the entire transport path within the high-performance printer 10. The transfer roller pairs of each and every group have a coinciding speed at every point in time, whereby this speed can change between $v_0$ and $v \times v_0$ ($v_0$ is the transfer printing speed of the printing units D1, D2) as well as in direction. The following table indicates what speeds in addition to the basic speed $v_0$ can occur for the various transport roller pairs T30 through T65.

| Transport Roller Pairs | Speeds: $v_0$ and, temporarily, the recited speeds |
|---|---|
| T30 | $2.5 \times v_0$ |
| T31; T32 | $2.5 \times v_0$ |
| T45; T46; T47 | $4 \times v_0$; 2, $2 \times v_0$ reverse |
| T48 | $3 \times v_0$; $4 \times v_0$; 2, $2 \times v_0$ rev. |
| T49; T50 | $2.2 \times v_0$;2, $5 \times v_0$ |
| T51; T52; T53; T54 | $4 \times v_0$; 2,5 $\times v_0$; 2, $2 \times v_0$ rev. |
| T55 | $4 \times v_0$ |
| T65 | $4 \times v_0$ |

Since the aforementioned speeds occur at various points in time during printing operation, only the independence of the various stepping motors M30 through M65 assures a high flexibility for the passage of the individual sheets in various operating modes. As mentioned, the transport roller pairs T30 through T65 are directly connected to the stepping motors M30 through M65, so that switching couplings can be eliminated.

Figure 9:
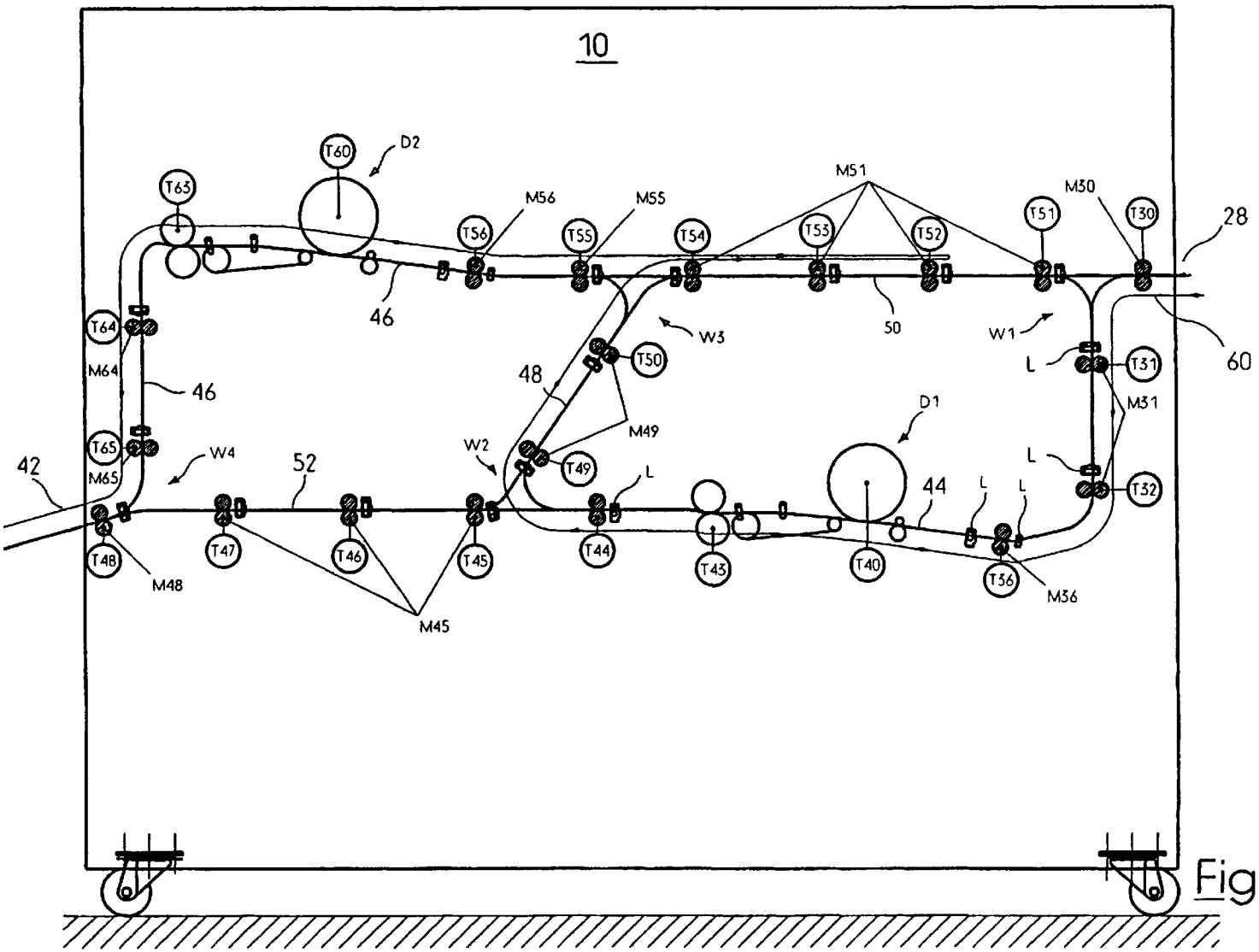
FIGS. 9–12 show the paper path in the printer for various operating modes.

The following FIGS. 9–12 schematically show the passage of individual sheets in the realization of various operating modes of the high-performance printer 10. The duplex mode is shown in FIG. 9, the front side and the back side of the individual sheets being printed therein by the printing unit D1 or, respectively, the printing unit D2. The passage is illustrated on the basis of the solid line 60 provided with directional arrows. Given turning at the shunt W3, the single sheet is conducted with its leading edge up to the light barrier of the transport roller pair T52. The rotational sense is then reversed and the single sheet is supplied via the shunt W3 to the printing unit D2.

Figure 10:
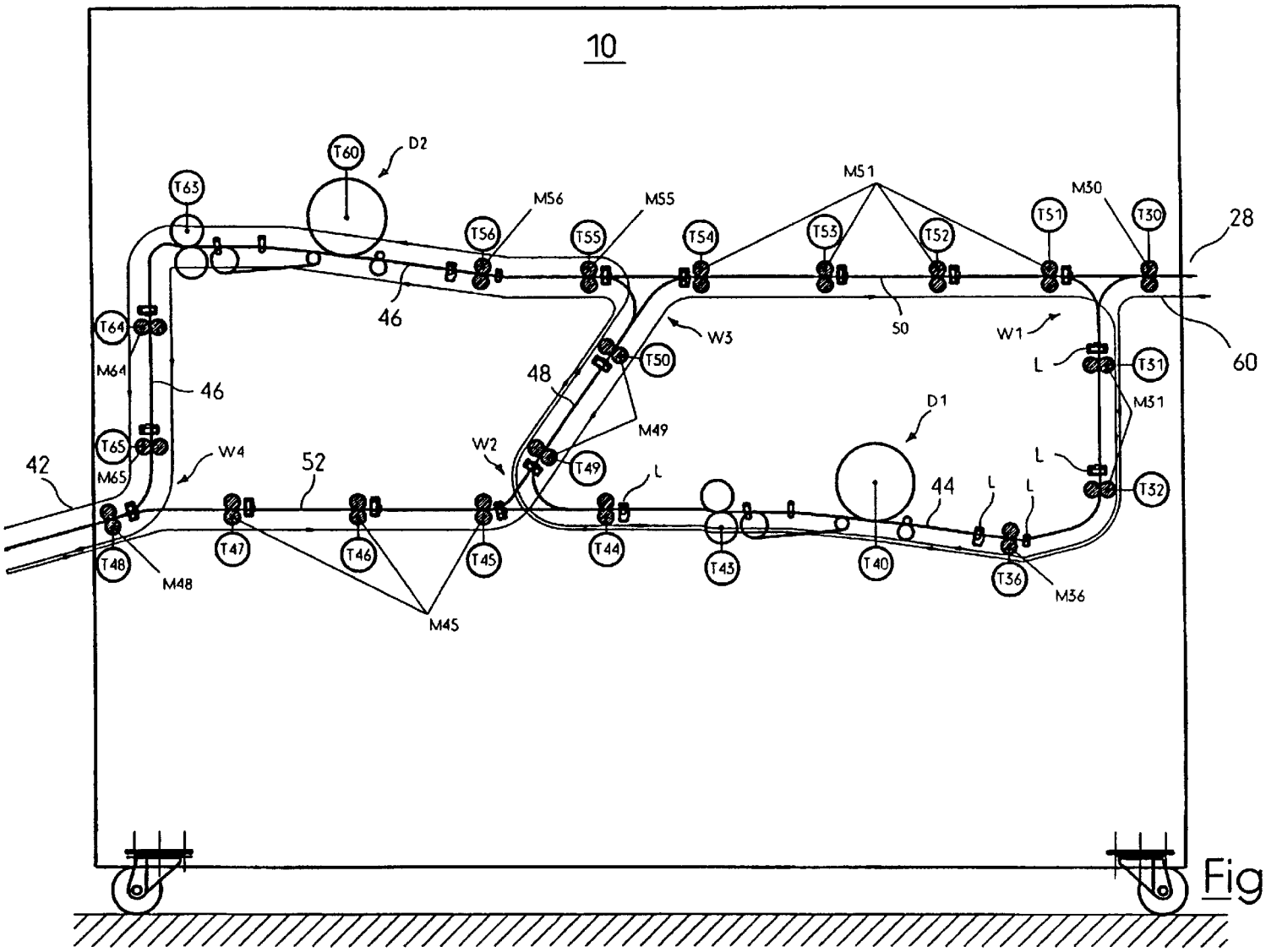

FIG. 10 schematically shows the passage in the operating mode of two-color duplex printing on the basis of the line 60, whereby the single sheets are conducted past the printing units D1 and D2 twice. The single sheets are turned in the shunt W4, as illustrated on the basis of the line 60.

Figure 11:
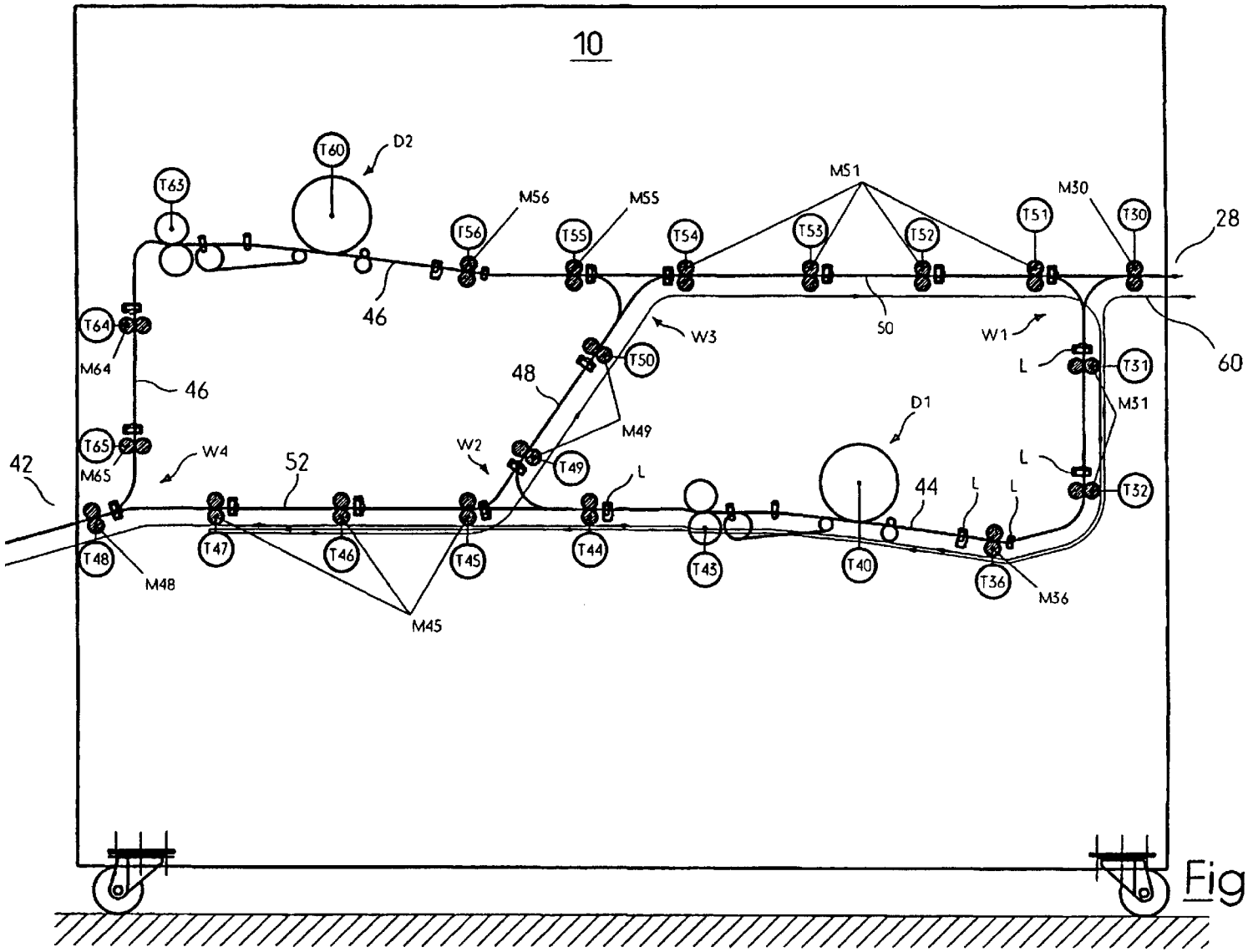

FIG. 11 shows the duplex printing with only printing unit D1. The passage of the single sheets is clear on the basis of the line 60. The single sheets are turned at the shunt W2.

Figure 12:
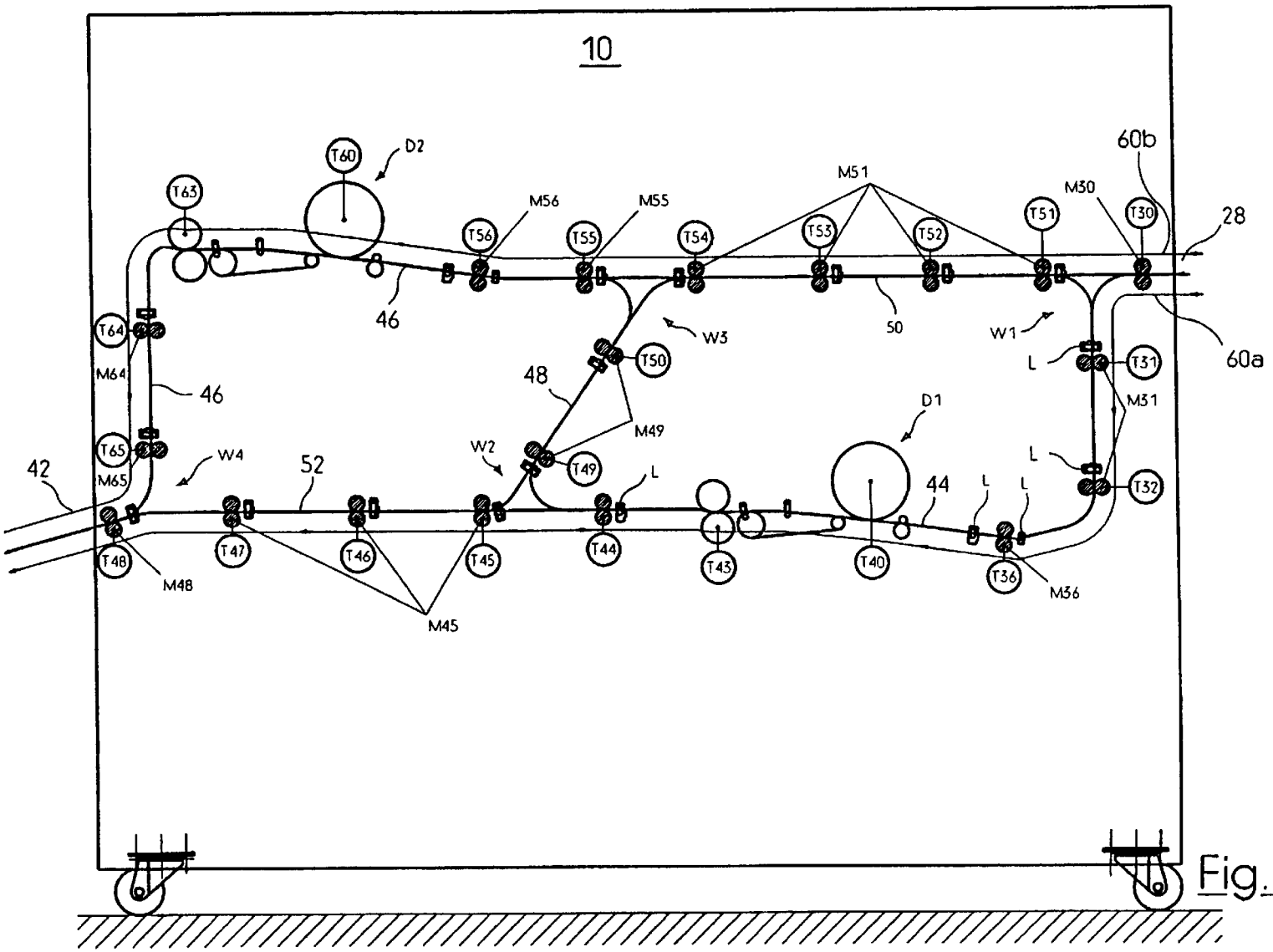

FIG. 12 shows the passage of single sheets along the lines 60*a*, 60*b* in the operating mode of alternative simplex printing, whereby the printing units D1 and D2 are supplied in alternating fashion with single sheets for printing the respective front side. The single sheets are supplied via the transport roller pair 30 with 2.5 times the speed. A division of the single sheets into the first transfer printing transport path 44 and the delivery channel 50 that discharges into the second transfer printing transport 46 occurs at the shunt W1. The single sheets are further-transported via the transport roller pairs 31, 32 with a speed of $2.5 \times v_0$. The single sheet is subsequently retarded in speed such that it is conducted past the printing unit D1 with transfer printing speed $v_0$. After passing through the fixing station with the transport roller pair T43, the single sheet is accelerated to a high transport speed, for example $4 \times v_0$, in order to be output at high speed via the transport roller pair T48. In an analogous way, the single sheets are conveyed on the delivery channel 50 and on the second transfer printing transport path 46.

By setting different speeds and different rotational senses of the transport roller pairs T30 through T65, it is possible in the various operating modes of the high-performance printer to in turn compensate the time losses required when passing through shunts and transport paths of different length within the high-performance printer 10, so that the single sheets are output in the output section 42 in the sequence in which they had been delivered to the input section 28. The accelerations and decelerations of the single sheets on the various transport paths is thereby set such that the predetermined spacings between the individual sheets are also adhered to. The required flexibility of the speeds of the individual transport roller pairs T30 through T65 is thereby assured by the stepping motors M30 through M65 that work clock-controlled, exact conveying paths being capable of being set as a result thereof.

Although various minor changes and modifications might be proposed by those skilled in the art, it will be understood that our wish is to include within the claims of the patent warranted hereon all such changes and modifications as reasonably come within our contribution to the art.

What is claimed is:

1. An apparatus, comprising:

a first electrographic printing unit that prints an image pattern on a sheet-shaped material;

an input section via which the sheet-shaped material is supplied individually in succession;

an output section over which the printed, sheet-shaped material is output individually in succession;

a turning device for the sheet-shaped material;

a second electronic printing unit supplied substantially identical to the first printing unit;

transport roller pairs driven by drives arranged in transport paths for the sheet-shaped material from the input section to the output section, transport roller pairs having a spacing from one another slightly smaller than a dimension of the sheet-shaped material in a conveying direction of the material;

the transport roller pairs having different rotational speeds and conveying directions dependent on an operating mode of the apparatus;

motors with reversible rotational sense provided as said drives;

predetermined pairs of said driven transport roller pairs being combined to form groups directly coupled to one another and respectively driven by a single drive;

one of said transport paths forming a first transfer printing transport path along the first printing unit and another of said transport paths forming a separate, second transfer printing transport path along the second printing unit;

the input section containing a shunt that supplies the sheet-shaped material either to the first transfer printing transport path or to the second transfer printing transport path;

the first transfer printing transport path and the second transfer printing transport path being connected by another one of said transport paths forming a connecting channel through which sheet-shaped material is conveyed in one or in both conveying directions;

the output section containing a shunt that supplies the sheet-shaped material from either the first or second transfer printing transport path to the output section;

at least one sensor arranged at at least one of the transport roller pairs, said sensor signaling passage of an edge of the sheet-shaped material; and a predetermined transport roller pair of said transport roller pairs which is accelerated or retarded dependent on signals of the sensor.

2. The apparatus according to claim 1, wherein the input section shunt supplies sheet-shaped material to the first transfer printing transport path and the second transfer printing transport path in alternating fashion.

3. The apparatus according to claim 1 wherein the connecting channel contains two transport roller pairs whose driven transport rollers are combined to form a group with a connecting channel stepping motor.

4. The apparatus according to claim 3 wherein the connecting channel stepping motor is operated, dependent on operating mode, with a speed approximately 2.2 times a transfer printing speed of the first and second printing units, or approximately 2.5 times the transfer printing speed.

5. The apparatus according to claim 1 wherein the turning unit contains a shunt, and the sheet-shaped material which is to be turned is first conducted past the turning unit shunt on a first path in a transport direction into a turning section, subsequently, the transport direction is reversed and the turning unit shunt conveys the sheet-shaped material to a second path in the other transport direction.

6. The apparatus according to claim 1 wherein a delivery channel connected between the input section and the second transport path contains four transport roller pairs whose driven transport rollers are combined as a group with a delivery channel stepping motor.

7. The apparatus according to claim 6 wherein the delivery channel stepping motor is operated, dependent on the operating mode, with a speed approximately four times a transfer printing speed approximately 2.5 times the transfer printing speed of the first and second printing units or approximately 2.2 times a reverse transfer printing speed of the first and second printing units.

8. The apparatus according to claim 1 wherein a discharge channel connected between the first transport path and the output section contains three transport roller pairs whose driven transport rollers are combined as a group with a discharge channel stepping motor.

9. The apparatus according to claim 8 wherein the discharge channel stepping motor is operated, dependent on the operating mode, with a speed approximately four times a transfer printing speed of the first and second printing units, or approximately 2.2 times a reverse transfer printing speed of the first and second printing units.

10. The apparatus according to claim 1 wherein the first transfer printing transport path contains two transport roller pairs in a conveying direction following the input section, the driven transport rollers thereof being combined as a group with a first stepping motor.

11. The apparatus according to claim 10 wherein the first stepping motor is operated, dependent on the operating mode, with a speed of approximately 2.5 times a transfer printing speed of the first and second printing units.

12. The apparatus according to claim 1 wherein the driven transport rollers of each and every group are connected to one another by toothed belts.

13. The apparatus according to claim 1 wherein further transport roller pairs not combined into groups are respectively separately driven by individual stepping motors.

14. The apparatus according to claim 1 wherein the first transfer printing transport path, the connecting channel and a delivery channel form a closed transport path, the delivery channel transporting sheet-shaped material in both directions and supplying sheet-shaped material to the second transfer printing transport path from the input section.

15. The apparatus according to claim 1 wherein the second transfer printing transport path, the connecting channel and a discharge channel for sheet-shaped material form a closed transport path, the discharge channel conveying sheet-shaped material in both directions and connecting the first transfer printing transport path to the output section.

16. The apparatus according to claim 1 wherein the input section contains a first shunt, a second shunt is arranged at a junction between said first transfer printing transport path, said connecting channel, and a discharge channel, a third shunt is arranged at a junction between said connecting channel, said second transfer printing transport path, and a delivery channel, and a fourth shunt is arranged at a junction between said second transfer printing transport path and said discharge channel.

17. The apparatus according to claim 1 wherein a sensor is arranged at every transport roller pair.

18. The apparatus according to claim 1 wherein the sensor contains two light barriers for recognizing a leading edge and a trailing edge of the sheet-shaped material.

19. The apparatus according to claim 1 wherein passage of a leading or a trailing edge of the sheet-shaped material is signaled by the sensor.

20. The apparatus according to claim 1 wherein the apparatus comprises a printer.

21. The apparatus according to claim 1 wherein the apparatus comprises a copier.

22. An apparatus, comprising:

a first electrographic printing unit that prints an image pattern on a sheet-shaped material;

an input section via which the sheet-shaped material is supplied individually in succession;

an output section over which the printed, sheet-shaped material is output individually in succession;

a turning device for the sheet-shaped material;

a second electronic printing unit supplied substantially identical to the first printing unit;

transport roller pairs driven by drives arranged in transport paths for the sheet-shaped material;

one of said transport paths forming a first transfer printing transport path along the first printing unit and another of said transport paths forming a separate, second transfer printing transport path along the second printing unit;

the input section containing a shunt that supplies the sheet-shaped material either to the first transfer printing transport path or to the second transfer printing transport path;

the first transfer printing transport path and the second transfer printing transport path being connected by another one of said transport paths forming a connecting channel through which sheet-shaped material is conveyed in one or in both conveying directions, a first end of said connecting channel connecting through a shunt directly to the shunt at the input section and also directly to an input of said second printing unit, and the other end of the connecting channel connecting through a shunt directly to an output of said first printing unit and directly to a shunt at said output section; and the output section containing said shunt supplying the sheet-shaped material from either the first or second transfer printing transport path to the output section.

23. A method for operating a printer or copier apparatus having first and second electrographic printing units which print image patterns on sheet-shaped material, comprising the steps of:

feeding the sheet-shaped material individually in succession at an input section;

outputting the sheet-shaped material at an output section individually in succession;

providing a turning device for the sheet-shaped material;

providing a first transport path for the first printing unit and a second transport path for the second printing unit;

providing a discharge channel from the first printing unit to the output section and providing a delivery channel from the input section to the second printing unit;

directly connecting with a second end of a connecting channel and then through a first end of the connecting channel, an output side of the first printing unit directly to an input side of the second printing unit, said first end of the connecting channel also directly connecting to said input section and said connecting channel second end and directly connecting to said output section;

providing transport roller pairs in transport paths for the sheet-shaped material, transport roller pairs having a spacing from one another smaller than a dimension of the material in a conveying direction of the material;

in a first simplex printing mode, transferring the sheets individually from the input section through the first printing unit to the output section;

in a first higher speed simplex mode feeding alternate sheets from the input section to the first and second printing units and outputting those sheets from the first and second printing units in alternate fashion to the output section;

in a duplex mode feeding individual sheets from the input section through the first printing unit via the first transport channel to a turning device, and via the connecting channel to the input of the second printing unit and then to the output section.

24. The method according to claim 23 including the step of providing the turning device at an output of the connecting channel so that the sheets are first transported along the connecting channel, are then turned, and are then fed to the second printing unit.

25. The method according to claim 23 wherein for a simplex two color printing mode, the individual sheets are fed in the first transport path to the first printing unit, and then along the connecting channel without turning to the second printing unit, with the first printing unit applying a first color and the second printing unit applying a second color at a same side of the sheets.

26. The method according to claim 23 including the step of providing transport roller pairs having different rotational speeds in conveying directions dependent on an operating mode of the apparatus along transport paths.

27. The method according to claim 23 including the step of sensing at at least one transport roller pair passage of an edge of the sheet-shaped material and dependent on signals from the sensing, accelerating or decelerating a predetermined transport roller pair.

28. A method for operating a printing or copier apparatus having first and second electrographic printing units which print image paterns on sheet-shaped material, comprising the steps of:

feeding the sheet-shaped material individually in succession at an input section;

outputting the sheet-shaped material at an output section individually in succession;

providing a turning device for the sheet-shaped material;

providing a first transport path for the first printing unit and a second transport path for the second printing unit;

providing a discharge channel from the first printing unit to the output section and providing a delivery channel from the input section to the second printing unit;

connecting with a connecting channel an output side of the first printing unit to an input side of the second printing unit;

providing transport roller pairs in transport paths for the sheet-shaped material, transport roller pairs having a spacing from one another smaller than a dimension of the material in a conveying direction of the material;

in a first simplex printing mode, transferring the sheets individually from the input section through the first printing unit to the output section;

in a first higher speed simplex mode, feeding alternate sheets from the input section to the first and second printing units and outputting those sheets from the first and second printing units in alternate fashion to the output section;

in a duplex mode, feeding individual sheets from the input section through the first printing unit via the first transport channel to a turning device, and via the connecting channel to the input of the second printing unit and then to the output section; and providing the turning device at an input end of the connecting channel so that the sheets leaving the first printing unit are first turned prior to entering the connecting channel.

29. A method for operating a printing or copier apparatus having first and second electrographic printing units which print image paterns on sheet-shaped material, comprising the steps of:

feeding the sheet-shaped material individually in succession at an input section;

outputting the sheet-shaped material at an output section individually in succession;

providing a turning device for the sheet-shaped material;

providing a first transport path for the first printing unit and a second transport path for the second printing unit;

providing a discharge channel from the first printing unit to the output section and providing a delivery channel from the input section to the second printing unit;

connecting with a connecting channel an output side of the first printing unit to an input side of the second printing unit;

providing transport roller pairs in transport paths for the sheet-shaped material, transport roller pairs having a spacing from one another smaller than a dimension of the material in a conveying direction of the material;

in a first simplex printing mode, transferring the sheets individually from the input section through the first printing unit to the output section;

in a first higher speed simplex mode feeding alternate sheets from the input section to the first and second printing units and outputting those sheets from the first and second printing units in alternate fashion to the output section;

in a duplex mode, feeding individual sheets from the input section through the first printing unit via the first transport channel to a turning device, and via the connecting channel to the input of the second printing unit and then to the output section; and combining various ones of the transport roller pairs to form groups directly coupled to one another and driving the grouped transport roller pairs by a single drive.

* * * * *